US006127972A

United States Patent [19]

Avidor et al.

[11] Patent Number: 6,127,972

[45] Date of Patent: Oct. 3, 2000

[54] TECHNIQUE FOR WIRELESS COMMUNICATIONS USING A MULTI-SECTOR ANTENNA ARRANGEMENT

[75] Inventors: Dan Avidor, Ocean, N.J.; Ashutosh Sabharwal, Columbus, Ohio

[73] Assignee: Lucent Technologies Inc., Murray Hill, N.J.

[21] Appl. No.: 09/069,325

[22] Filed: Apr. 29, 1998

[51] Int. Cl.[7] ..... H01Q 3/26

[52] U.S. Cl. ..... 342/373; 342/367; 342/372; 455/13.4

[58] Field of Search ..... 370/318; 455/13.4, 455/226.1, 226.3, 422; 342/367, 370, 372, 373

[56] References Cited

U.S. PATENT DOCUMENTS

| | | | |
|---|---|---|---|
| 3,760,419 | 9/1973 | Poschadel et al. | 343/109 |
| 4,639,914 | 1/1987 | Winter | 370/110.1 |
| 5,576,711 | 11/1996 | Morris et al. | 342/152 |
| 5,644,599 | 7/1997 | Hess | 375/267 |
| 5,739,788 | 4/1998 | Dybdal et al. | 342/355 |
| 5,819,168 | 10/1998 | Golden et al. | 455/303 |
| 5,848,060 | 12/1998 | Dent | 370/281 |

OTHER PUBLICATIONS

O. Bucci et al., "Antenna Pattern Synthesis: A New General Approach," *Proceedings of the IEEE*, vol. 82, No. 3, Mar. 1994, pp. 356–371.

A. Safaai–Jazi, "A New Formulation of the Design of Chebyshev Arrays," *IEEE Transactions on Antennas and Propagation*, vol. 42, No. 3, Mar. 1994, pp. 439–443.

Y. Kim et al., "Shaped–Pattern Synthesis Using Pure Real Distributions," *IEEE Transactions on Antennas and Propagation*, vol. 36, No. 11, Nov. 1988, pp. 1645–1649.

J. Evans, "Synthesis of Equiripple Sector Antenna Patterns," *IEEE Transactions on Antennas and Propagation*, May 1976, pp. 347–353.

*Primary Examiner*—Thomas H. Tarcza
*Assistant Examiner*—Dao L. Phan

[57] ABSTRACT

In a base station for providing wireless cellular service, an antenna arrangement is employed to transmit information to Mobile terminals, e.g., cellular radiotelephones, in a cell. The cell is divided into sectors. The antenna arrangement includes a number of antennas, each of which is used to serve one or more of the sectors. However, transmission of an antenna to a sector corresponding thereto is interfered by transmissions of other antennas to their corresponding sectors. To reduce such inter-sector interference in each sector, each antenna is designed to maximize beam efficiency of the sector, which is defined as a ratio of the power transmitted to the sector by the corresponding antenna to the total power radiated from the antenna.

44 Claims, 5 Drawing Sheets

TECHNIQUE FOR WIRELESS COMMUNICATIONS USING A MULTI-SECTOR ANTENNA ARRANGEMENT

FIELD OF THE INVENTION

The invention relates to communications systems and methods, and more particularly to a system and method using a multi-sector antenna arrangement to communicate information in a wireless manner.

BACKGROUND OF THE INVENTION

In a wireless cellular service, a service area is typically divided into a multiplicity of cells. A base station is employed in each cell to serve mobile terminals, e.g., cellular radiotelephones, in the cell to realize wireless communications. In a well known manner, the base station performs call administration, and establishes and maintains telephone connections between mobile terminals in the corresponding cell and other communication terminals, which may or may not be mobile terminals, via, e.g., a public switched telephone network (PSTN) connected to the base station. After a telephone connection is established, the base station receives in a wireless manner communication information from a mobile terminal at one end of the connection, and transmits same to a communication terminal at the other end thereof, and vice versa.

It is common to use a multi-sector antenna arrangement in the base station for transmission and reception of communication information to and from mobile terminals in the cell. The cell is divided into N typically, but not necessarily, equal sectors, where N is an integer greater than one. If the sectors are equal, each sector covers an angular span of $2\pi/N$ radians of the cell. The multi-sector antenna arrangement includes multiple antennas for transmitting and receiving N sector beams containing the communication information to and from the N sectors, respectively. It is generally believed that the number of mobile terminals which can be effectively served in a cell increases linearly with the number of the sector beams used, i.e., N.

When considering the optimization of the cellular wireless service performance, the focus of the prior art is invariably on the design of a radiation pattern of a sector beam. The radiation pattern typically includes a main lobe flanked by sidelobes. The main lobe represents the bulk of power of the sector beam transmitted to the corresponding sector. The sidelobes represent the remaining power of the sector beam radiated outside the sector, which causes undesirable interference to the transmissions to other sectors. Such interference is known as "inter-sector interference." The prior art design of the radiation pattern typically involves pre-selecting a set of constraints on the radiation pattern to attempt to, for example, shape the sidelobes into a desired pattern to minimize the inter-sector interference. These constraints include, for example, requirements of the power levels of the maxima of the sidelobes, locations of the sidelobe maxima with respect to the main lobe, etc. A solution satisfying the pre-selected constraints is then obtained if such a solution exists at all. However, the solution, if any, generally does not account for all important characteristics of the design, which can be defined only after the design is realized.

Moreover, in practice, a base station normally implements multiple sector beams in a cell, and each sector in the cell is afflicted by inter-sector interference aggregately caused by those sector beams transmitted to other sectors in the same cell. However, the pattern and effect of such inter-sector interference contributed by more than one sector beam are hardly predictable based on the design of the radiation pattern of an isolated sector beam, on which the prior art technique focuses. The unpredictability of the inter-sector interference is exacerbated if the sectors are unequal. As a result, use of the prior art technique to achieve the optimal service performance is, at best, precarious, and whether such performance is achievable thereby is also in question.

Accordingly, there exists a need for a dependable methodology to improve the wireless cellular service performance by, for example, effectively reducing the inter-sector interference.

SUMMARY OF THE INVENTION

The invention overcomes the prior art limitations by increasing "beam efficiency" of each sector to reduce the inter-sector interference, under a constraint on an in-sector ripple measure described below, without regard for the resulting actual shape of the sidelobes in radiation pattern on which the prior art design focuses as described above. Beam efficiency of a sector is defined as a ratio of the power transmitted to the sector by the corresponding antenna to the total power radiated from the antenna. The beam efficiency varies inversely with the inter-sector interference. Thus, in accordance with the invention, an antenna is designed to control the proportion of power of the sector beam transmitted thereby to the corresponding sector to increase the beam efficiency, which results in a decrease in the inter-sector interference.

In accordance with an aspect of the invention, the beam efficiency can be effectively maximized, subject to the aforementioned constraint on the in-sector ripple measure, which is indicative of uniformness of distribution of the transmitted power over the sector. Since it is desirable to have such a power distribution as uniform over the sector as possible, the inventive technique advantageously offers an effective way of not only reducing the inter-sector interference, but also imposing a desired limit on the non-uniformness of the power distribution.

BRIEF DESCRIPTION OF THE DRAWING

Throughout this disclosure, unless otherwise stated, like elements, components and sections in the figures are denoted by the same numerals.

DETAILED DESCRIPTION

Figure 1:
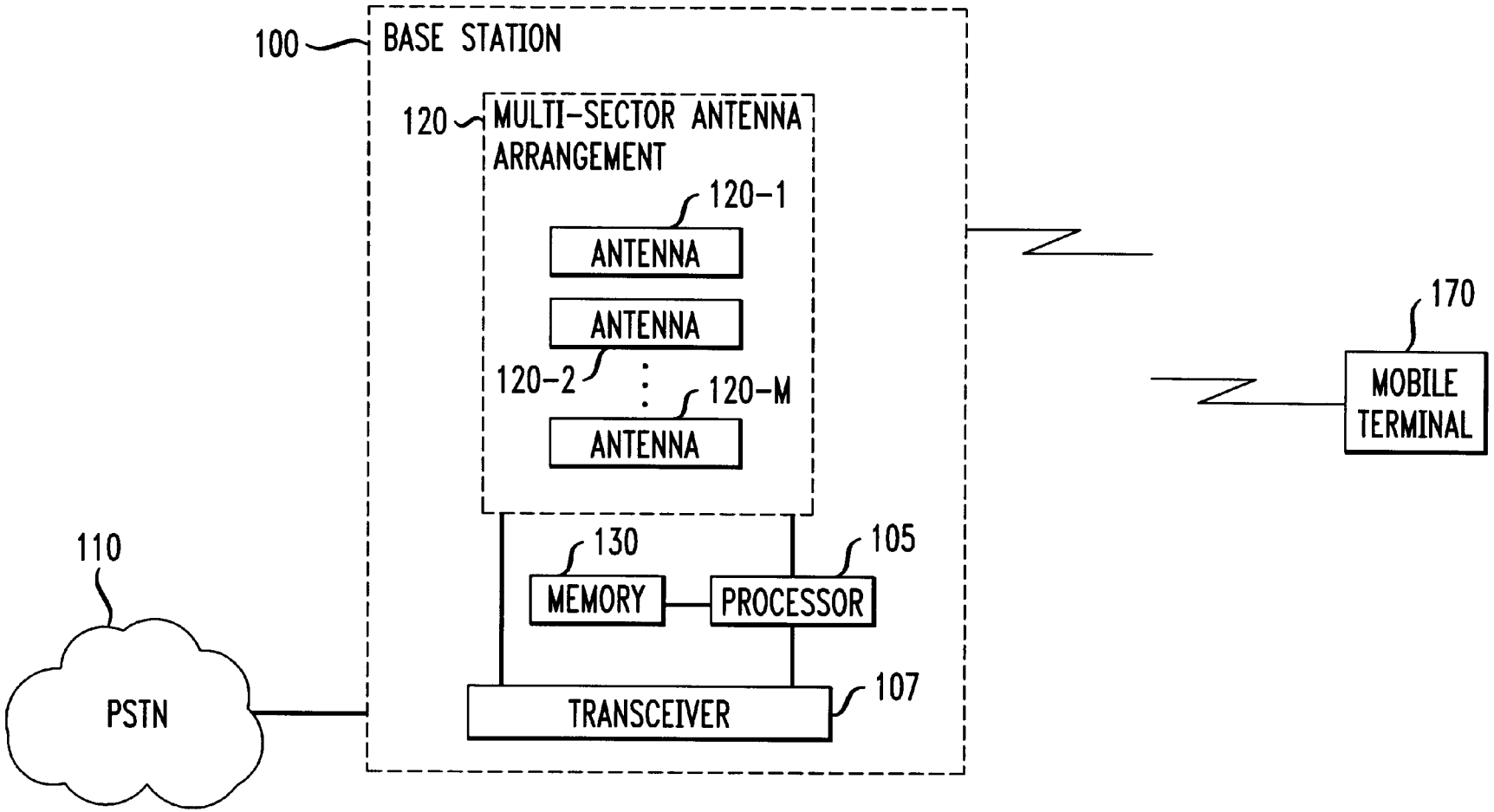
FIG. 1 illustrates a communication arrangement including a base station for providing a wireless cellular service in accordance with the invention.

Use of a wireless cellular service for communications is ubiquitous nowadays. Typically, the service area is divided into a multiplicity of cells. FIG. 1 illustrates base station 100 embodying the principles of the invention, which provides the wireless cellular service to mobile terminals, e.g., cellular radiotelephones, in one such cell, e.g., cell 200 in FIG. 2. Cell 200, illustratively circular in shape, defines the geographic coverage by base station 100 located at center O. Base station 100 serves only those mobile terminals within cell 200. It will be appreciated that a person skilled in the art may define cell 200 in different shapes than a circular shape here, depending on the specific terrain topography of the service area and constraints related to the base station.

Referring back to FIG. 1, central to base station 100 is processor 105 which, among other things, performs such well known functions as call administration, and establishment and maintenance of telephone connections between mobile terminals in cell 200 and other communication terminals, which may or may not be mobile terminals, via, e.g., a public switched telephone network (PSTN) 110 connected to base station 100. For example, after a telephone connection is established between a mobile terminal, e.g., mobile terminal 170, in cell 200 and a communication terminal (not shown) connected to PSTN 110, transceiver 107 of conventional design receives via PSTN 110 communication information from the communication terminal. Processor 105 causes the received information to be transmitted in a wireless manner to mobile terminal 170 through multi-sector antenna arrangement 120 in accordance with the invention. Conversely, arrangement 120 receives in a wireless manner communication information from mobile terminal 170. Processor 105 causes transceiver 107 to transmit the received information to the communication terminal through PSTN 110, thereby realizing duplex communications.

Figure 2:
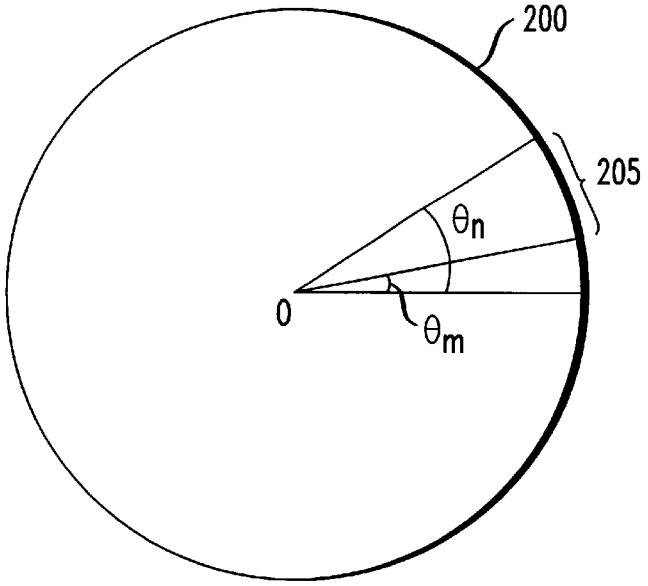
FIG. 2 illustrates a cell served by the base station.

In this particular illustrative embodiment, multi-sector antenna arrangement 120 comprises antennas 120-1 through 120-M, which are structurally identical, and cell 200 is equally divided into N sectors, where N and M are integers greater than zero, and N is a multiple of M. FIG. 2 shows one such sector denoted 205. As shown in FIG. 2, sector 205 lies between $\theta_m$ and $\theta_n$, with $\theta_n>\theta_m$. Thus, in this instance, $N=2\pi/(\theta_n-\theta_m)$. Antennas 120-1 through 120-M together transmit N sector beams containing communication information to the N sectors of cell 200. That is, each antenna generates L=N/M sector beams directed toward the respective L sectors of cell 200. In this instance, sector 205 is associated with antenna 120-1, and one of the L sector beams generated by antenna 120-1 is transmitted toward sector 205.

Figure 3:
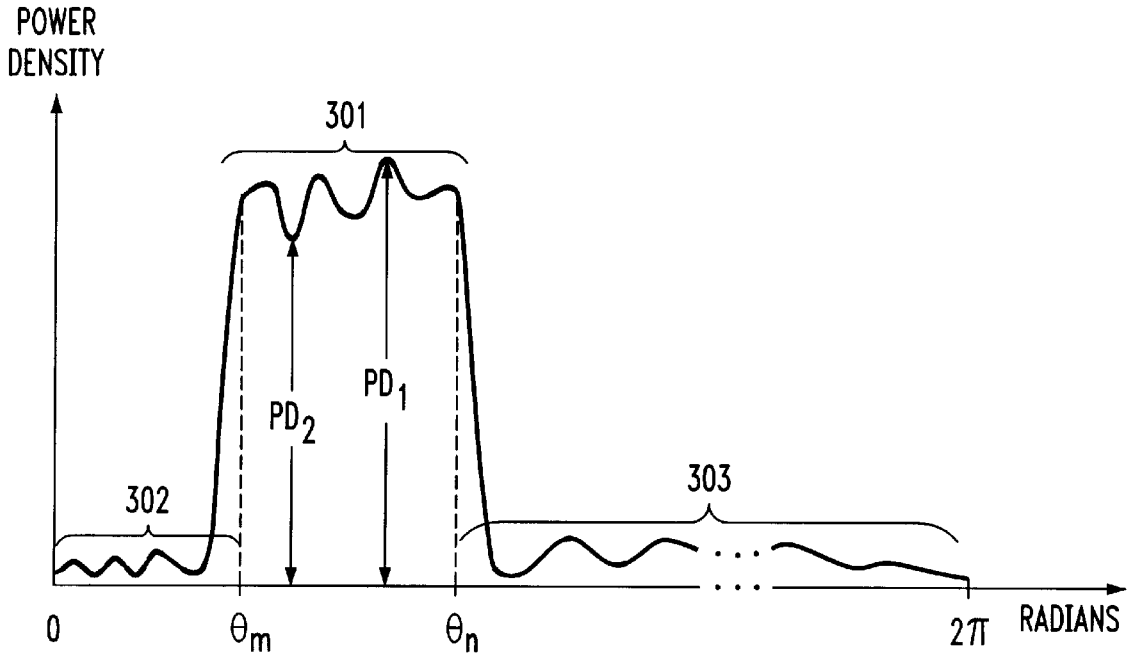
FIG. 3 illustrates a radiation pattern of a sector beam generated by an antenna in the base station.

It is generally believed that the number of mobile terminals which can be effectively served in a cell increases linearly with the number of sector beams used in a cell, i.e., N. In the prior art, to optimize the cellular wireless service performance, the focus is invariably on the design of a radiation pattern of a sector beam. FIG. 3 illustrates a representative radiation pattern, which includes main lobe 301 flanked by two series of sidelobes denoted 302 and 303, respectively. For example, main lobe 301 may represent the bulk of power of the sector beam transmitted by antenna 120-1 to sector 205, and the two series of sidelobes may respectively represent the remaining power radiated outside sector 205, which causes the undesirable inter-sector interference to other sectors in cell 200. The prior art design of the radiation pattern typically involves pre-selecting a set of constraints on the radiation pattern to attempt to, for example, shape the sidelobes into a desired pattern to minimize the inter-sector interference. These constraints include, for example, requirements of the power levels of the maxima of the sidelobes, locations of the sidelobe maxima with respect to the main lobe, etc. A solution satisfying the pre-selected constraints is then obtained if such a solution exists at all. However, the solution, if any, generally does not account for all important characteristics of the design, which can be defined only after the design is realized.

Moreover, in practice, a base station, e.g., base station 100, normally implements multiple sector beams in a cell, and each sector in the cell is afflicted by inter-sector interference aggregately caused by those sector beams transmitted to other sectors in the same cell. However, the pattern and effect of such inter-sector interference contributed by more than one sector beam are hardly predictable based on the design of the radiation pattern of an isolated sector beam, on which the prior art technique focuses. The unpredictability of the inter-sector interference is exacerbated if the sectors are unequal. As a result, use of the prior art technique to achieve the optimal service performance is, at best, precarious, and whether such performance is achievable thereby is also in question.

The invention overcomes the prior art limitations by increasing "beam efficiency" of each sector to reduce inter-sector interference under a constraint on an in-sector ripple measure described below. Beam efficiency of a sector is defined as a ratio of the power transmitted to the sector by the corresponding antenna to the total power radiated from the antenna. The beam efficiency varies inversely with the inter-sector interference. That is, the higher the beam efficiency each sector enjoys, the lower is the aggregate inter-sector interference afflicting the sector. In accordance with the invention, each antenna is designed to maximize the percentage of power of each sector beam transmitted thereby to the corresponding sector, subject to the aforementioned constraint on the in-sector ripple measure, denoted r.

For example, in FIG. 3, the maximum and minimum power density values of a ripple appearing on main lobe 301 of the sector beam transmitted to sector 205 are denoted $PD_1$ and $PD_2$, respectively. The in-sector ripple measure r is defined as the ratio of $PD_1$, to $PD_2$, i.e., $r=PD_1/PD_2\geqq 1$, and is indicative of uniformness of a distribution of the beam power over sector 205. Ideally, a mobile terminal in sector 205 should be afforded uniform beam power anywhere in sector 205. Accordingly, r should be constrained to a small value close to 1 or 0 dB.

Figure 4:
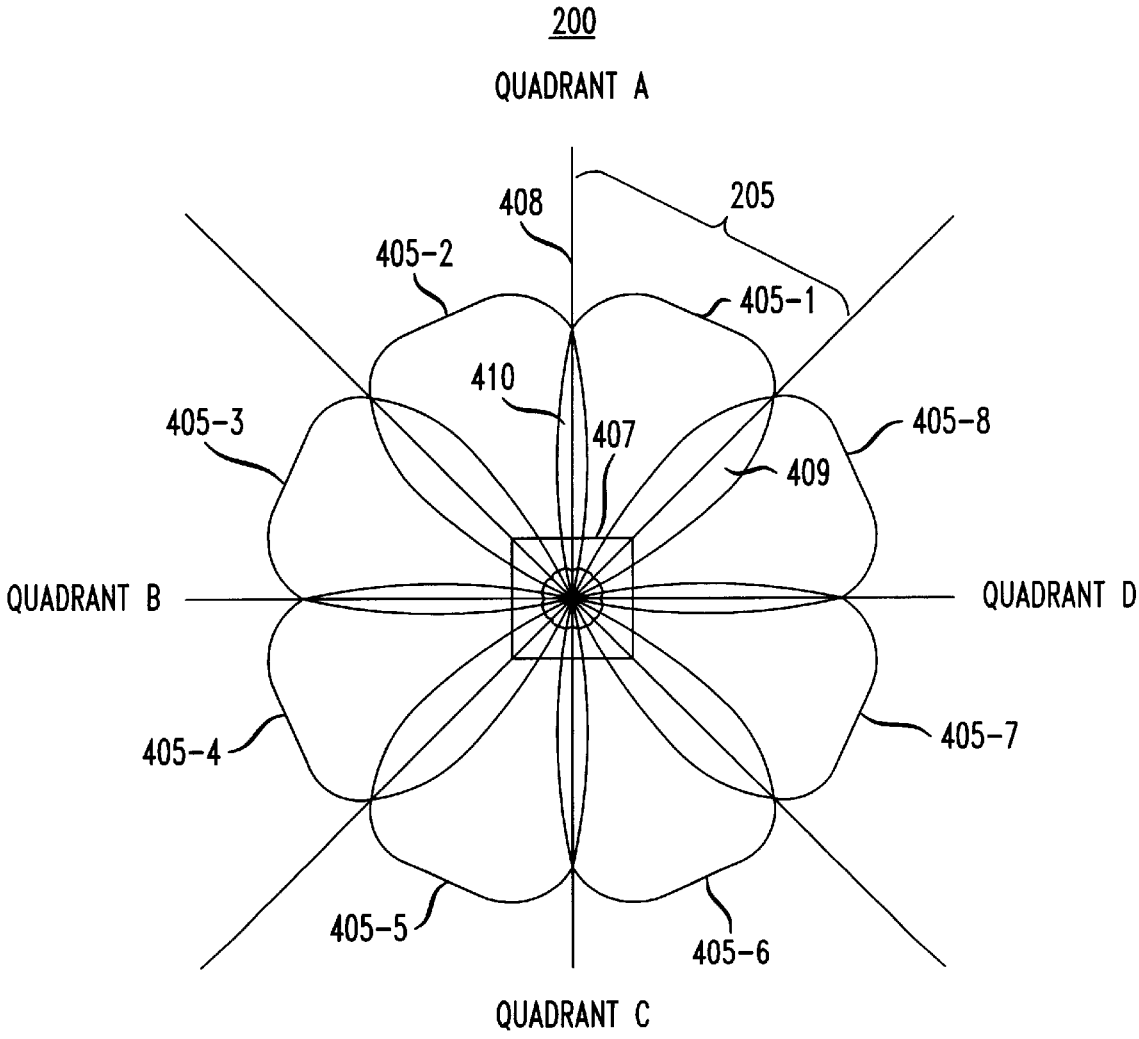
FIG. 4 illustrates eight sector beams covering the cell of FIG. 2, which are generated by four antennas in accordance with the invention.

FIG. 4 illustrates a distribution of N=8 sector beams over cell 200, which are generated by a particular version of multi-sector antenna arrangement 120 having M=4 antennas. As shown in FIG. 4, cell 200 is divided into eight equal sectors each having a $\pi/4$ radian span. Each sector is covered by a respective one of the eight sector beams, denoted 405-1 through 405-8, respectively. Antennas 120-1 through 120-4 are arranged in a square format indicated by square 407, with each side thereof representing one of such antennas. As described below, each antenna in this instance is structured based on a linear phased array antenna comprising an array of radiators arranged along a straight line. Each antenna is associated with a respective one of four quadrants, namely, quadrants A, B, C and D, defined in cell 200. Each quadrant in this example includes two sectors, which are respectively covered by L=2 sector beams generated by the associated antenna.

In particular, antenna 120-1 transmits sector beams 405-1 and 405-2 to quadrant A, of which sector beam 405-1 covers sector 205 which spans an angular width of $\pi/4$ radians from line 408, which represents the normal to the radiator array of antenna 120-1. Sector beam 405-1 covers sector 205, and extends beyond its borders and into its neighboring sectors, causing undesirable inter-sector interference. Such inter-sector interference is indicated by overlaps of sector beams, denoted 409 and 410. However, with antennas in arrangement 120 designed to synthesize sector beams having the maximum beam efficiency in accordance with the invention, the inter-sector interference occasioned thereby is substantially reduced, with respect to the prior art antennas.

Figure 5:
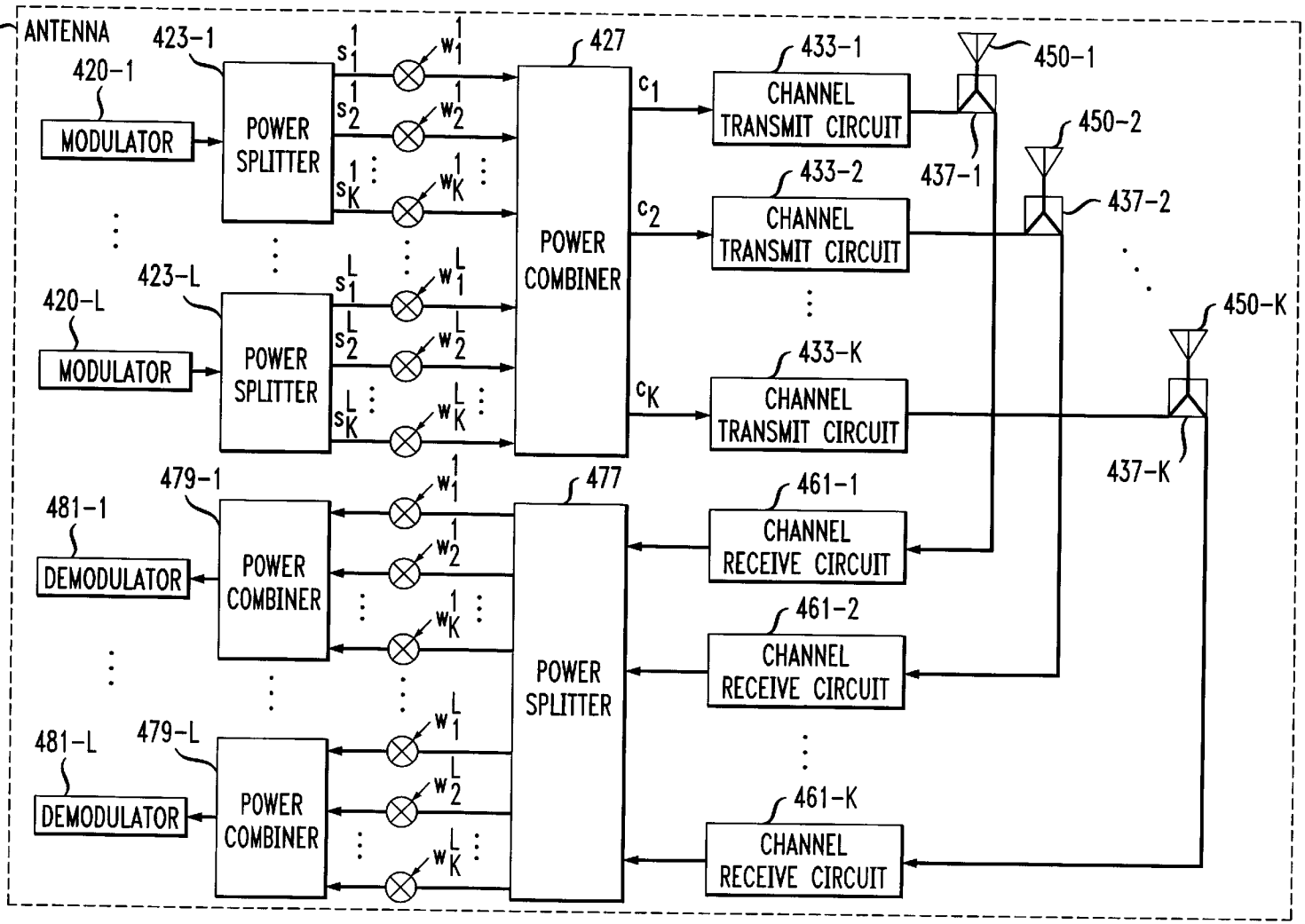
FIG. 5 is a block diagram of an antenna in accordance with the invention.

Without loss of generality, the design of antenna 120-1 in accordance with the invention will now be described. The design of each other antenna in arrangement 120 similarly follows. As shown in FIG. 5, antenna 120-1 is, as mentioned before, illustratively structured based on a linear phased array antenna. Specifically, it includes an array of K radiators, denoted 450-1, 450-2, . . . 450-i, . . . and 450-K, and respectively arranged at locations $x_1$, $x_2$, . . . $x_i$, . . . and $x_K$ along a straight line, where K is an integer greater than one, and $1 \leqq i \leqq K$.

In transmit direction E, antenna 120-1 includes modulator 420-1 through modulator 420-L which respectively receive L input signals representative of communication information to be transmitted to the L sectors associated with antenna 120-1. In response, each of modulators 420-1 through 420-L in a well known manner provides a modulated signal to a respective one of power splitters 423-1 through 423-L. Each power splitter divides the power of the corresponding modulated signal into a set of K equal signal outputs. Thus, a first set of signal outputs by power splitter 423-1 contains signals $s_i^1$, $1 \leqq i \leqq K$; a second set of signal outputs by power splitter 423-2 contains signals $s_i^2$, $1 \leqq i \leqq K$; . . . and an $L^{th}$ set of signal outputs by power splitter 423-L contains signals $S_i^L$, $1 \leqq i \leqq K$. The K signals in each signal set corresponding to a sector are respectively multiplied by K complex weights corresponding to the same sector to adjust the phase and amplitude of the signals. The specific values of these complex weights are determined below to maximize the beam efficiency in accordance with the invention. It suffices to know for now that such complex weights are $w_1^1$, $w_2^1$, . . . and $w_K^1$ corresponding to a first sector served by antenna 120-1; $w_1^2$, $w_2^2$, . . . and $w_K^2$ corresponding t o a second sector served thereby; . . . ; and $w_1^L$, $w_2^L$ . . . and $w_K^L$ corresponding to an $L^{th}$ sector served thereby.

Accordingly, L sets of weighted signal outputs, namely, $\{s_1^1 w_1^1, s_2^1 \ldots, s_K^1 w_K^1\}$, $\{s_1^2 w_1^2, s_2^2 w_2^2 \ldots, s_K^2 w_K^2\}$, . . . , and $\{s_1^L w_1^L, s_2^L w_2^L \ldots, s_K^L w_K^L\}$, are provided to power combiner 427. The latter combines the corresponding weighted signal outputs in the L sets, yielding combination signals $c_i$, $1 \leqq i \leqq K$, respectively. That is, $c_1 = s_1^1 w_1^1 + s_1^2 w_1^2 \ldots + s_1^L w_1^L$, $c_2 = s_2^1 w_2^1 + s_2^2 w_2^2 \ldots + s_2^L w_2^L$, . . . , and $c_K = s_K^1 w_K^1 + s_K^2 w_K^2 \ldots + s_K^L w_K^L$.

The combination signals are fed to channel transmit circuits 433-i, $1 \leqq i \leqq K$, respectively, where the combination signals are up-converted, filtered and amplified in a well known manner for transmission. The resulting outputs are provided to radiators 450-i $1 \leqq i \leqq K$, through diplexers 437-i of conventional design. Accordingly, each of radiators 450-i, which may be directional, generates an electromagnetic wave having a wavelength λ, whose spatial power distribution is represented by a radiation pattern $Q_i(\theta)$, where θ is measured from a line normal to the radiator array. As a result, the voltage radiation pattern (V(θ)) of a sector beam transmitted by radiators 450-i, $1 \leqq i \leqq K$, to a sector corresponding to complex weights $w_i$, in general, can be expressed as follows:

$$V(\theta) = \sum_{i=1}^{K} w_i Q_i(\theta) \exp\left(-j\frac{2\pi}{\lambda} x_i \sin(\theta)\right) = \sum_{i=1}^{K} w_i g_i(\theta), \quad [1]$$

where $$g_i(\theta) = Q_i(\theta) \exp\left(-j\frac{2\pi}{\lambda} x_i \sin(\theta)\right)$$

and $j=(-1)^{1/2}$. It is apparent from expression [1] that the choice of $w_i$'s determines the radiation pattern V(θ) when all other parameters of the array are specified.

Without loss of generality, let's assume $w_i$, $1 \leqq i \leqq K$, in this instance corresponds to sector 205 which lies between $\theta_m$ and $\theta_n$ radians as mentioned before. Accordingly, the beam efficiency η of sector 205 is expressed as follows:

$$\eta = \frac{\int_{\theta_m}^{\theta_n} |V(\theta)|^2 \, d\theta}{\int_{-\pi}^{\pi} |V(\theta)|^2 \, d\theta}. \quad [2]$$

Based on expression [1], the power p radiators 450-1 and 450-K onto sector 205 spanning $[\theta_m \; \theta_n]$ can be expressed as follows:

$$\begin{aligned} p_{[\theta_m,\theta_n]} &= \int_{\theta_m}^{\theta_n} |V(\theta)|^2 \, d\theta \\ &= \int_{\theta_m}^{\theta_n} \left[\sum_{i=1}^{K} w_i g_i(\theta)\right] \left[\sum_{k=1}^{K} w_k g_k(\theta)\right]^* d\theta \\ &= \sum_{i=1}^{K} \sum_{k=1}^{K} w_i w_k^* \int_{\theta_m}^{\theta_n} g_i(\theta) g_k^*(\theta) \, d\theta \\ &= W^H A W, \end{aligned} \quad [3]$$

where an element with a superscript "*" represents a complex conjugate of the element without the superscript; $W=[w_1, w_2 \ldots w_K]^T$ represents a complex weight vector, where a superscript "T" represents a standard vector transposition operation; $W^H$ is a matrix representing the complex conjugate of $W^T$; and matrix A in this instance is Hennitian, i.e., $A^H=A$, and positive definite for all values of $\theta_m$ and $\theta_n$, and is defined by its matrix components $A_{ik}$ as follows:

$$A_{ik} = \int_{\theta_m}^{\theta_n} g_i(\theta) g_k^*(\theta) \, d\theta.$$

By substituting $\theta_m=-\pi$ and $\theta_n=\pi$ in expression [3], the total power radiated by radiators 450-1 through 450-K can be expressed as follows:

$$p_{[-\pi,\pi]} = W^H R W, \quad [4]$$

where matrix R, a symmetric and positive definite matrix, is defined by its matrix components $R_{ik}$ as follows, and is real if $Q_i(\theta)$ is symmetric about θ=0 for all i=1, . . . , K:

$$R_{ik} = \int_{-\pi}^{\pi} g_i(\theta) g_k^*(\theta)\, d\theta.$$

Based on expressions [3] and [4], the beam efficiency η of sector 205 can be rewritten as follows:

$$\eta = \frac{p_{[\theta_m,\theta_n]}}{p_{[-\pi,\pi]}} = \frac{W^H A W}{W^H R W} = \frac{U^H R^{-1/2} A R^{-1/2} U}{U^H U} = \frac{U^H T U}{U^H U}, \quad [5]$$

where matrix $U=R^{1/2}W$; matrix $R^{1/2}$ represents the matrix square root of R; and matrix T is expressed as follows:

$$T=R^{-1/2}AR^{-1/2}.$$

It is evident from expression [5] that maximizing beam efficiency in absence of any constraints requires finding the eigenvector corresponding to the maximum eigenvalue of matrix T. It should be noted that matrix T is a function of such antenna design variables as K, d/λ (where d represents the spacing between two neighboring radiators in a special case where radiators 450-1 through 450-K are uniformly spaced), $Q_i(\theta)$ and $[\theta_m\theta_n]$, but is independent of complex weight vector W. As such, the maximum beam efficiency pattern (or the subspace of patterns if the maximum eigenvalue of T is non-unique) can be identified as soon as values for those design variables are specified. The present process of identifying the maximum possible beam efficiency helps one to select a realistic value for the constraint used in the design process, which is the aforementioned in-sector ripple measure r, in accordance with the invention.

The in-sector ripple measure r (in dB) is expressed as follows, and is a function of W based on expression [1]:

$$r(W) = 20\log_{10}\frac{\max_{\theta\in[\theta_m,\theta_n]}|V(\theta)|}{\min_{\theta\in[\theta_m,\theta_n]}|V(\theta)|}. \quad [6]$$

The present task of identifying $W_{opt}$, which represents an optimal complex vector comprising a set of ordered complex weights $w_1$, through $w_k$ to be implemented in antenna 120-1 to achieve the maximum beam efficiency under the ripple constraint, r, can be summarily described as follows:

$$W_{opt} = \underset{r\le\delta}{\operatorname{argmax}}\,\eta(W), \quad [7]$$

where δ represents a pre-selected constraint value for r. That is, find a W which maximizes η under the constraint $r\leqq\delta$.

The Lagrangian L for the optimization problem framed in [7] is expressed as follows:

$$L(W,\alpha)=-\eta+\alpha(r-\delta). \quad [8]$$

By differentiating L, the following first-order optimality conditions are obtained:

$$-\frac{\partial\eta}{\partial W} + \alpha\frac{\partial r}{\partial W} = 0,$$

and $$r=\delta. \quad [9]$$

Figure 6:
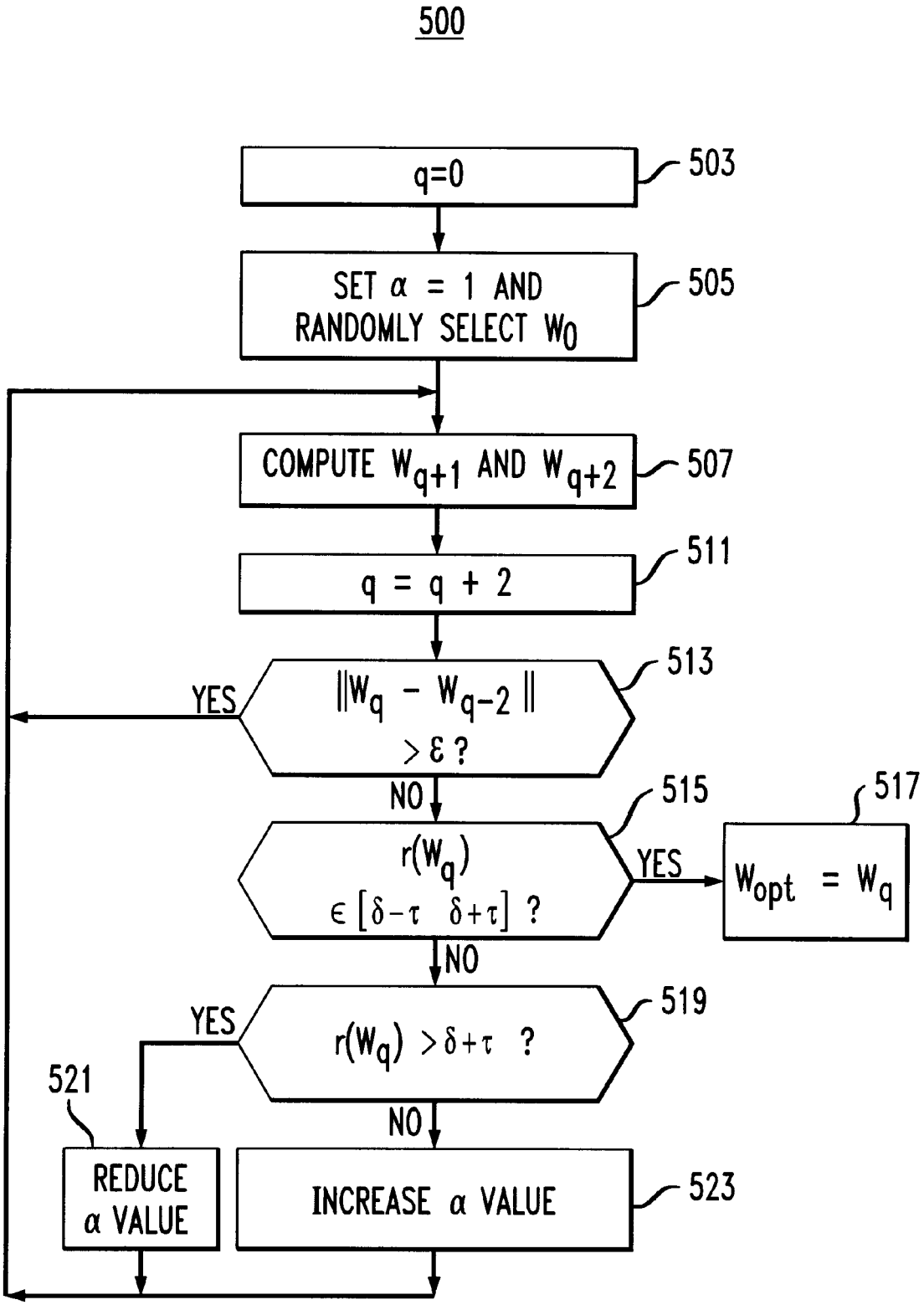
FIG. 6 is a flow chart depicting the steps for determining certain design parameters of the antenna of FIG. 5.

To solve the optimization problem with such conditions, routine 500 in FIG. 6 is employed, which is stored in memory 130 and run by processor 105 in this instance. It should be noted that routine 500 may be run off-line by a computer independent of base station 100, instead. However, it may be advantageous to have processor 105 re-evaluate $W_{opt}$ in real time using routine 500 in response to, for example, load shifting between day service and night service, or the dynamic change of the subscriber population in the cell, which may result in a different number of sectors used or sector configuration.

In any event, instructed by routine 500 which comprises an iteration process, processor 105 initializes an index q, setting q=0, as indicated at step 503. At step 505, processor 105 sets α=1 and selects random values for vector components in $W_0$. Processor 105 then computes at step 507 $W_{q+1}$, and $W_{q+2}$ defined as follows:

$$W_{q+1} = W_q + \beta\frac{\partial\eta}{\partial W}\Big|_{W=W_q}, \text{ and} \quad [10]$$

$$W_{q+2} = W_{q+1} - \alpha\beta\frac{\partial r}{\partial W}\Big|_{W=W_{q+1}}, \quad [11]$$

where the value of β, is predetermined and represents a step size in each iteration. Thus, a small β value causes the number of iterations, and thus the process time, to increase, while a large β value leads to identification of a less precise $W_{opt}$, Since W is a complex vector, taking the derivative of η and r with respect to W results in the following:

$$\frac{\partial\eta}{\partial W} = \frac{\partial\eta}{\partial(\mathrm{Re}(W))} + j\frac{\partial\eta}{\partial(\mathrm{Im}(W))}, \quad [12]$$

where Re(W) represents the real part of W, and Im(W) represents the imaginary part of W.

The partial derivatives on the right of "=" in expression [12] can be computed numerically based on the following relation:

$$\frac{\partial f(x)}{\partial x} = \frac{f(x+\varepsilon)-f(x-\varepsilon)}{2\varepsilon},$$

where ε, like β, represents a tolerance parameter having a predetermined value, and a large β, normally calls for a large ε.

Accordingly, at step 51 1, processor 105 increments q by two, i.e., q=q+2. Processor 105 at step 513 determines whether the magnitude $\|W_q-W_{q-2}\|$ is greater than or equal to ε. If it is determined that $\|W_q-W_{q-2}\|\geqq\epsilon$, routine 500 returns to step 507 previously described. Otherwise, routine 500 proceeds to step 515 where processor 105 further determines whether $r(W_q)$ is between the values (δ−τ) and (δ+τ), inclusive, where r represents another tolerance parameter having a predetermined value, and a large β normally calls for a large τ. If it is determined that $r(W_q)\in[\delta-\tau\ \delta+\tau]$, routine 500 ends with $W_{opt}=W_q$, as indicated at step 517. Otherwise, processor 105 further determines whether $r(W_q)>\delta+\tau$, as indicated at step 519. If it is determined that $r(W_q)>\delta+\tau$, processor 105 increases the previous α value, as indicated at step 521, from which routine 500 returns to step 507. Otherwise, i.e., $r(W_q)<\delta-\tau$, processor 105 reduces the previous α value, as indicated at step 523, from which routine 500 also returns to step 507.

We observed from computed results that there is a tradeoff between the beam efficiency η and the in-sector ripple constraint r. Specifically, a smaller ripple constraint leads to a lower beam efficiency which, based on our finding mentioned before, leads to a higher inter-sector interference.

Referring back to FIG. 5, in receive direction F, radiators 450-i, $1 \leqq i \leqq K$, in antenna 120-1 receive L sector beams associated therewith, including the sector beam comprising transmitted signals representative of communication information from mobile terminals in sector 205. Accordingly, each radiator provides, through one of diplexers 437-i, $1 \leqq i \leqq K$, a received signal representative of a version of the combined received beams to one of channel receive circuits 461-i. The latter perform the inverse function to channel transmit circuits 433-i, $1 \leqq i \leqq K$, described above to down-convert, filter and amplify the received signals, respectively. The resulting signals are provided to power splitter 477 performing the inverse function to power combiner 427 described above. The output of power splitter 477 comprises L sets of K signals corresponding to the L sectors served by antenna 120-1. The K signals in each set corresponding to a sector are respectively multiplied by the complex weights corresponding to the same sector, which are determined above. The weighted signal sets are fed to power combiners 479-1 through 479-L, which perform the inverse function to aforementioned power splitters 423-1 through 423-L, respectively. The outputs of power combiners 479-1 through 479-L are then demodulated by demodulators 481-1 through 481-L. The latter perform the inverse function to modulator 421 described above, yielding L signals representative of communications information from the respective L sectors.

The foregoing merely illustrates the principles of the invention. It will thus be appreciated that a person skilled in the art will be able to devise numerous systems which, although not explicitly shown or described herein, embody the principles of the invention and are thus within its spirit and scope.

For example, in the disclosed embodiment, each antenna, e.g., antenna 120-1, is illustrated based on a linear phased array antenna. However, the invention is equally applicable where any other types of phased array antennas are used, including antennas having other geometry, such as planar or circular geometry.

In addition, in the disclosed embodiment, cell 200 is divided into N equal sectors. It will be appreciated that in implementing the invention, a person skilled in the art may divide the cell into any number of equal or unequal sectors, which may cover the $2\pi$, radian span in whole or in part.

Finally, although base station 100 as disclosed is embodied in the form of various discrete functional blocks, base station 100 could equally well be embodied in a different arrangement in which the functions of any one or more of those blocks or indeed, all of the functions thereof, are realized, for example, by one or more appropriately programmed processors or devices.

We claim:

1. Apparatus for transmitting at least one beam containing information to a selected area, the apparatus comprising:

an antenna for radiating the at least one beam toward the selected area, a portion of power of the at least one beam being distributed to the selected area; and a controller for controlling a ratio of the portion of power of the at least one beam to total power of the at least one beam radiated from the antenna, the ratio varying with a measure indicative of uniformness of distribution of the portion of power of the at least one beam over the selected area.

2. The apparatus of claim 1 wherein the antenna includes a linear phased array antenna.

3. The apparatus of claim 1 wherein the ratio is indicative of beam efficiency of the selected area.

4. The apparatus of claim 1 further comprising a processor for causing the controller to maximize the ratio.

5. The apparatus of claim 1 wherein the antenna includes a plurality of radiators for generating the at least one beam.

6. The apparatus of claim 5 wherein the controller includes a processor for determining a plurality of weight values, each weight value being applied to a respective one of the plurality of radiators to generate the at least one beam.

7. Apparatus for transmitting at least one beam containing information to a cell, the cell being divided into a plurality of sectors, the apparatus comprising:

an antenna for radiating the at least one beam toward a selected sector in the cell, a portion of power of the at least one beam being distributed to the selected sector; and a controller for setting a ratio of the portion of power of the at least one beam to total power of the at least one beam radiated from the antenna, the ratio varying with a measure indicative of uniformness of distribution of the portion of power of the at least one beam over the selected sector.

8. The apparatus of claim 7 wherein the antenna includes a linear phased array antenna.

9. The apparatus of claim 7 wherein the ratio is indicative of beam efficiency of the selected sector.

10. The apparatus of claim 7 wherein the controller sets the ratio dynamically in response to changes in predetermined conditions.

11. The apparatus of claim 7 wherein the antenna includes a plurality of radiators for generating the at least one beam.

12. The apparatus of claim 11 wherein the controller includes a processor for determining a plurality of weight values, each weight value being applied to a respective one of the plurality of radiators to generate the at least one beam.

13. A system for communicating information with a plurality of communication terminals in an area, the area including a plurality of sections, the system comprising:

at least one antenna for transmitting a signal containing information to a selected one of the plurality of sections, the signal being receivable by one of the plurality of communication terminals which is in the selected section, power of the transmitted signal being distributed amongst the plurality of sections; and a controller for controlling a proportion of the power of the transmitted signal distributed to the selected section, the proportion being a function of a constraint on uniformness of distribution of the power of the transmitted signal over the selected section.

14. The system of claim 13 further comprising a base station for providing wireless communications to the plurality of communication terminals.

15. The system of claim 13 wherein each section is identical in shape.

16. The system of claim 13 wherein the area comprises a cell including a plurality of sectors, the selected section including at least one sector in the cell.

17. The system of claim 16 wherein the signal comprises at least one beam transmitted toward the at least one sector.

18. The system of claim 17 wherein the proportion is indicative of beam efficiency of the at least one sector.

19. The system of claim 13 wherein the at least one antenna includes a mechanism for receiving a second signal containing information from the at least one communication terminal.

20. The system of claim 13 further comprising a processor for causing the controller to maximize the proportion.

21. A communications system comprising:

means for identifying at least one weight value; and means responsive to the at least one weight value for transmitting a signal representative of information toward a selected area, a portion of power of the signal being distributed to the selected area, the at least one weight value being identified to affect a magnitude of the portion of power of the signal relative to total power of the signal, the magnitude varying with a measure indicative of uniformness of distribution of the portion of power of the signal over the selected area.

22. The system of claim 21 wherein the at least one weight value being identified to maximize the magnitude of the portion of power of the signal.

23. The system of claim 21 wherein the identifying means includes means for computing the at least one weight value based on a Lagrangian.

24. The system of claim 23 wherein the at least one weight value being computed using an iterative process.

25. The system of claim 21 further comprising means responsive to the at least one weight for receiving a second signal representative of information from the selected area.

26. A method for transmitting at least one beam containing information to a selected area, the method comprising the steps of:

radiating the at least one beam toward the selected area, a portion of power of the at least one beam being distributed to the selected area; and controlling a ratio of the portion of power of the at least one beam to total power of the at least one beam radiated from the antenna, the ratio varying with a measure indicative of uniformness of distribution of the portion of power of the at least one beam over the selected area.

27. The method of claim 26 wherein the ratio is indicative of beam efficiency of the selected area.

28. The method of claim 26 wherein the controlling step includes the step of maximizing the ratio.

29. The method of claim 26 wherein the controlling step includes the step of determining a plurality of weight values, and the radiating step includes the step of generating the at least one beam in response to the weight values.

30. A method for transmitting at least one beam containing information to a cell, the cell being divided into a plurality of sectors, the method comprising the steps of:

radiating the at least one beam toward a selected sector in the cell, a portion of power of the at least one beam being distributed to the selected sector; and setting a ratio of the portion of power of the at least one beam to total power of the at least one beam radiated from the antenna, the ratio varying with a measure indicative of uniformness of distribution of the portion of power of the at least one beam over the selected sector.

31. The method of claim 30 wherein the ratio is indicative of beam efficiency of the selected sector.

32. The method of claim 30 wherein the ratio is set dynamically in response to changes in predetermined conditions.

33. A method for use in a system for communicating information with a plurality of communication terminals in an area, the area including a plurality of sections, the method comprising the steps of:

transmitting a signal containing information to a selected one of the plurality of sections, the signal being receivable by one of the plurality of communication terminals which is in the selected section, power of the transmitted signal being distributed amongst the plurality of sections; and controlling a proportion of the power of the transmitted signal distributed to the selected section, the proportion being a function of a constraint on uniformness of distribution of the power of the transmitted signal over the section.

34. The method of claim 33 further comprising the step of providing wireless communications to the communication terminals.

35. The method of claim 33 wherein the area comprises a cell including a plurality of sectors, the selected section including at least one sector in the cell.

36. The method of claim 35 wherein the signal comprises at least one beam transmitted toward the at least one sector.

37. The method of claim 36 wherein the proportion is indicative of beam efficiency of the at least one sector.

38. The method of claim 33 wherein each section is identical in shape.

39. The method of claim 33 wherein the controlling step includes the step of maximizing the proportion.

40. A communications method comprising the steps of:

identifying at least one weight value; and in response to the at least one weight value, transmitting a signal representative of information to a selected area, a portion of power of the signal being distributed to the selected area, the at least one weight value being identified to affect a magnitude of the portion of power of the signal relative to total power of the signal, the magnitude varying with a measure indicative of uniformness of distribution of the portion of power of the signal over the selected area.

41. The method of claim 40 wherein the at least one weight value being identified to maximize the magnitude of the portion of power of the signal.

42. The method of claim 40 wherein the identifying step includes the step of computing the at least one weight value based on a Lagrangian.

43. The method of claim 42 wherein the at least one weight value being computed using an iterative process.

44. The method of claim 40 further comprising the step of receiving a second signal representative of information from the selected area in response to the at least one weight value.

* * * * *